US005829326A

United States Patent [19]

Richner

[11] Patent Number: 5,829,326

[45] Date of Patent: Nov. 3, 1998

[54] COVER PLATE FOR A RATCHET WRENCH

[75] Inventor: Derek Richner, Whatley, Mass.

[73] Assignee: Hand Tool Design Corporation, Wilmington, Del.

[21] Appl. No.: 932,799

[22] Filed: Sep. 4, 1997

[51] Int. Cl.[6] ..... B25B 13/46

[52] U.S. Cl. ..... 81/60

[58] Field of Search ..... 81/58, 60, 61, 81/62, 63, 63.1, 63.2; 220/787, 789, 791

[56] References Cited

U.S. PATENT DOCUMENTS 5,406,876 4/1995 Harless et al. .
5,474,124 12/1995 Samuels et al. .
5,498,008 3/1996 Chase et al. .
5,503,446 4/1996 De Jong .
5,568,671 10/1996 Harris et al. .
5,638,577 6/1997 Gooding et al. .

*Primary Examiner*—Eileen P. Morgan
*Assistant Examiner*—Joni B. Danganan
*Attorney, Agent, or Firm*—Leonard Bloom

[57] ABSTRACT

A cover plate for a ratchet wrench having a flat body and a plurality of spaced-apart segments formed on a lower surface of the cover plate. Each segment has a chamfered protrusion and a step formed on the protrusion. The protrusion engages a channel formed within the opening in the head of the ratchet wrench to lock the cover plate to the ratchet wrench.

17 Claims, 5 Drawing Sheets

COVER PLATE FOR A RATCHET WRENCH

BACKGROUND OF THE INVENTION

The present invention relates to ratchet wrenches, and more particularly, to a cover plate which is retained on the wrench without screws or retaining rings.

Cover plates are used on ratchet wrenches to minimize the infiltration of dirt into the opening in the head of the wrench in which the drive gear and pawl are located. The usual means to retain the cover plate on the wrench is by screws which extend through the cover plate or by one or more retaining rings which are disposed over the cover and are secured to the head of the wrench. These require a multiplicity of parts and assembly time and contribute to the overall costs of the ratchet wrench.

The applicant is unaware of any cover plates having gripping segments to retain the cover plate in the head of the ratchet wrench. In U.S. Pat. No. 5,406,876 Harless et al disclose a munitions store retention and release system wherein a plurality of integral, circumferentially spaced resilient, locking fingers have terminal projections, extending radially inwardly. The locking fingers are engaged by a lug and urged radially into their associated windows until the terminal projections on the fingers firmly engage the annular groove on the lug, thus securing the store to the rack.

In U.S. Pat. No. 5,474,124 Samuels discloses a wellhead retrieval tool assembly wherein a check valve has a spear formed as a solid ring at the bottom with free fingers extending upward. The fingers are resilient and have protrusions adapted to engage a retrieval groove in the check valve.

Chase et al in U.S. Pat. No. 5,498,008 disclose a chuck jaw locking apparatus for a rotatable machine tool such as lathe wherein collet fingers are formed with enlargements at the ends of the fingers. A circumferential groove is formed having a registration shoulder for all the lock jaw segments, each of which has a protruding tab.

De Jong in U.S. Pat. No. 5,503,446 discloses a device for gripping and handling objects such as compact discs wherein gripping fingers can be displaced from each other in a radial direction of a hole to be engaged.

In U.S. Pat. No. 5,568,671 Harris et al disclose a caster assembly with an integral plastic stem and horn and with a removable axle lock cap wherein the horn sidewalls have fingers forming slots receiving grooved end portions of the axle.

In U.S. Pat. No. 5,638,577 Gooding et al disclose an automobile jack handle having a retainer sleeve with integral prong elements in one elongated rod section that are selectively engaged and disengaged from cooperation with an integral retention collar in another retention cooperating rod section.

Thus, there is a need for a simple, inexpensive cover plate for use with ratchet wrenches.

BRIEF SUMMARY OF THE INVENTION

It is an object of the present invention to provide an inexpensive cover plate for the opening in the head of a ratchet wrench which has a minimum number of parts and can be installed with minimum labor.

In accordance with the teachings of the present invention, there is disclosed a cover plate for use with a ratchet wrench. The ratchet wrench has a head portion having an opening formed therein, the opening having a channel formed peripherally therein. The cover plate includes a body having an upper surface and a lower surface. A plurality of spaced-apart segments are formed on the lower surface of the body and extend substantially perpendicularly thereto and away from the upper surface. Each segment has an end distal from the lower surface. A respective protrusion is formed on the end of each segment. Each protrusion has a portion chamfered outwardly from the end of the respective segment toward the lower surface. Each protrusion has a step formed thereon, the step being oriented toward the lower surface. When the lower surface of the body of the cover plate is disposed in the opening in the head of the ratchet wrench, the chamfered portion of each segment is directed into the channel. The step on each segment is locked in the channel, wherein a seal is formed between the cover plate and the head of the ratchet wrench and preventing the infiltration of dirt into the opening in the head of the wrench.

A method of covering the opening in the head of a ratchet wrench is further disclosed.

These and other objects of the present invention will become apparent from a reading of the following specification taken in conjunction with the enclosed drawings.

DESCRIPTION

Figure 1:
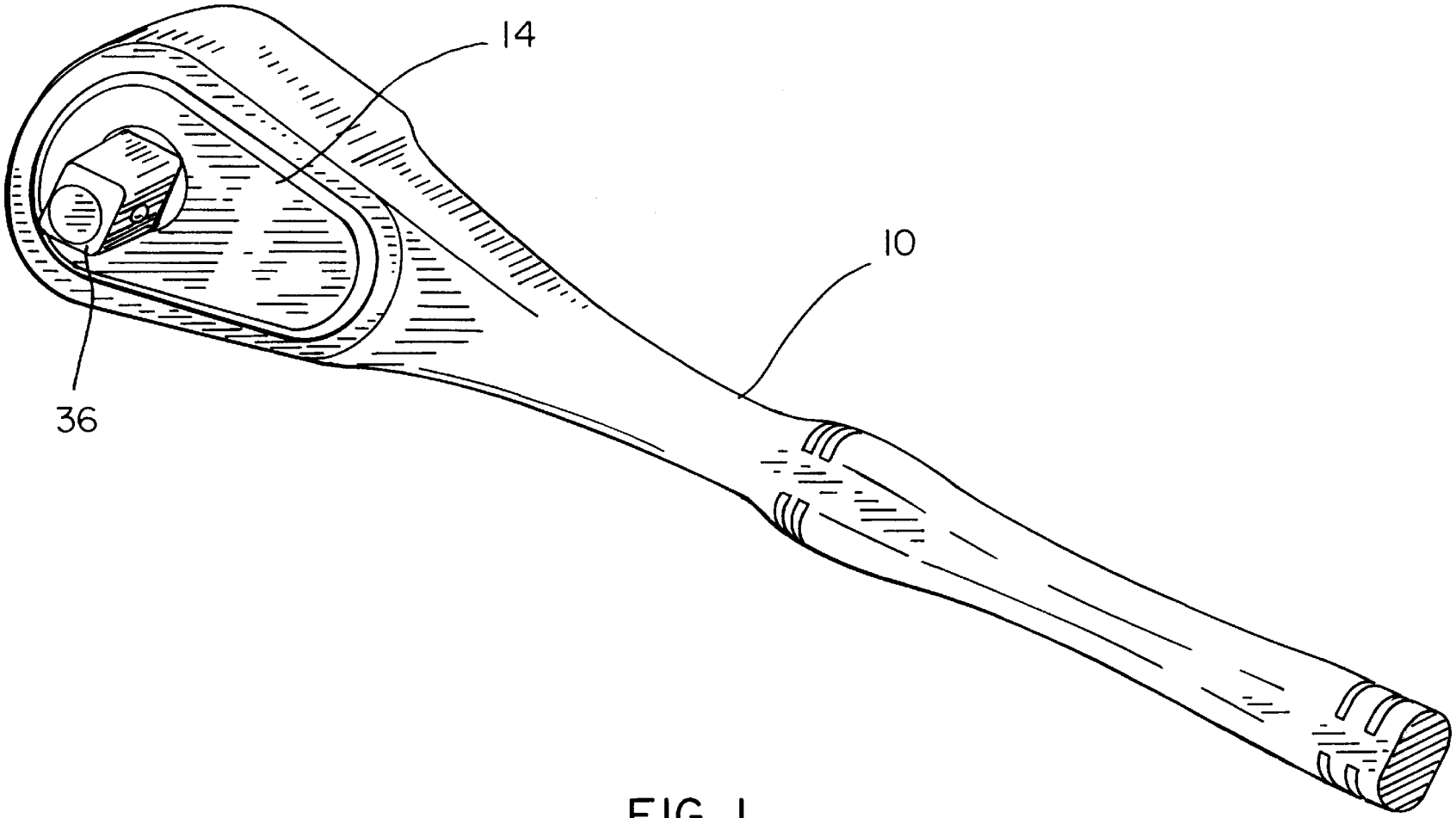
FIG. 1 is a perspective view of the bottom of a ratchet wrench showing the cover plate of the present invention installed thereon.
Figure 4:
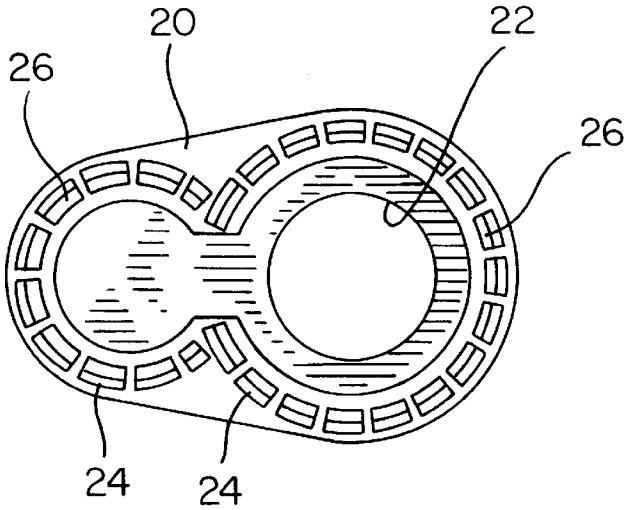
FIG. 4 is a bottom plan view of the present invention.
Figure 2:
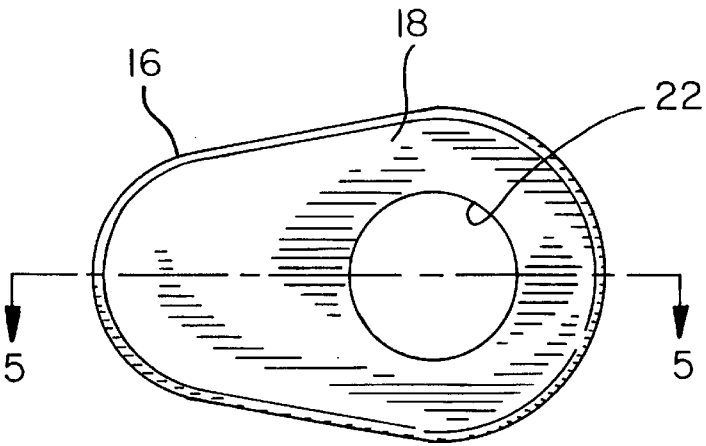
FIG. 2 is a top plan view of the cover of the present invention for the ratchet wrench.
Figure 5:
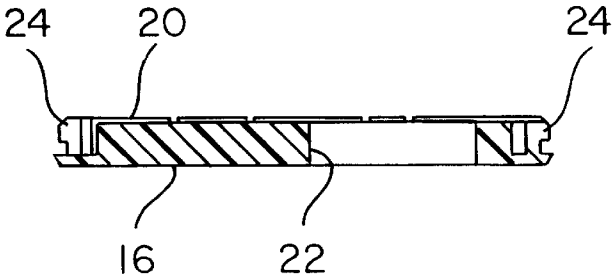
FIG. 5 is a cross-sectional view taken across the lines 5—5 of FIG. 2.
Figure 3:
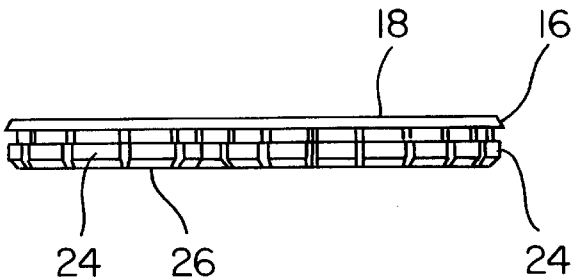
FIG. 3 is a side elevation view of the present invention.

Referring now to FIGS. 1–12, the ratchet wrench 10 has an opening 12 formed therein in which there is mounted a gear drive (not shown) and a pawl (not shown). The cover plate 14 of the present invention is shown in FIG. 1 mounted flushly on the ratchet wrench and covering the opening 12.

As shown in FIGS. 2–5, the cover plate 14 has a body 16 with an upper surface 18 and an opposite lower surface 20. A through opening 22 is formed between the upper surface 18 and the lower surface 20. A plurality of spaced-apart segments 24 are formed peripherally on the lower surface 20 of the body 16. Each segment 24 has an end 26 distal from the lower surface 20. Each segment 24 further has a protrusion 28 formed on each respective end 26, the protrusion 28 being oriented outwardly from the opening 22 in the cover plate 14. Each protrusion 28 further has a chamfered portion 30 which is formed outwardly from the end 26 of the respective segment 24 toward the lower surface 20 of the body 16. Each segment further has a step 32 formed thereon. The step 32 is oriented with a planar surface oriented toward the lower surface 20. It is preferred that the planar surface of the step 32 be approximately parallel with the lower surface 20 of the body 16. The segments 24 are disposed on the lower surface 18 in an order to correspond with the contour of the opening 12 in the head of the ratchet wrench.

Figure 7:
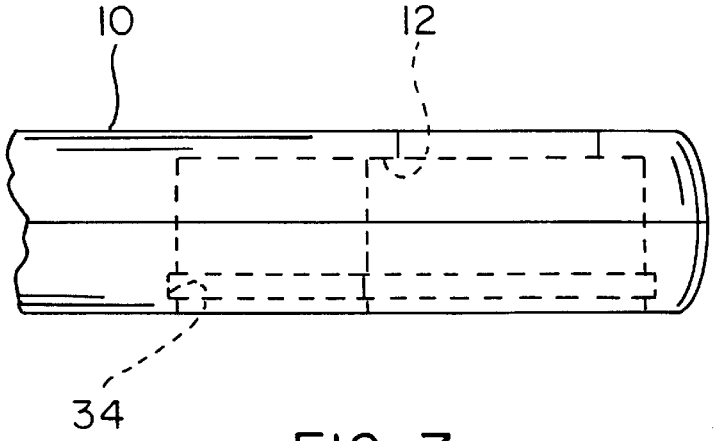
FIG. 7 is a side elevation view of the head of the ratchet wrench showing, in broken lines, the opening and the channel within the head of the wrench.
Figure 8:
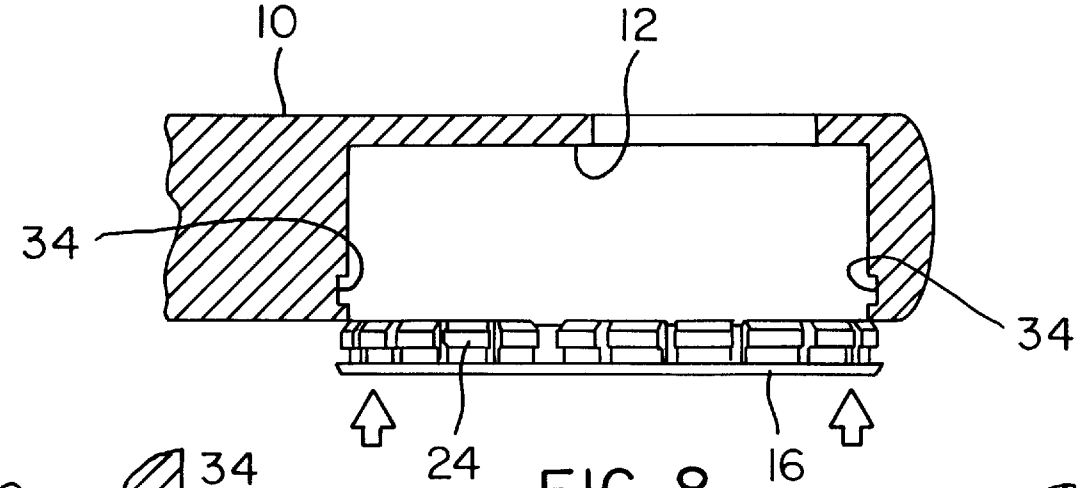
FIG. 8 is a cross-sectional view showing the cover plate of the present invention being inserted into the opening in the head of the ratchet wrench.

The opening 12 in the head of the ratchet wrench 10 may be in the form of two overlapping circles in which the drive gear and the pawl are disposed or may be in any other configuration known to persons skilled in the art and appropriate to the particular ratchet wrench. Peripherally within the opening 12, there is formed a receiving means such as a channel 34 as shown in FIG. 7. Preferably, the channel 34 is near the edge of the opening 12, close to the outer face of the head of the ratchet wrench 10.

Figure 6:
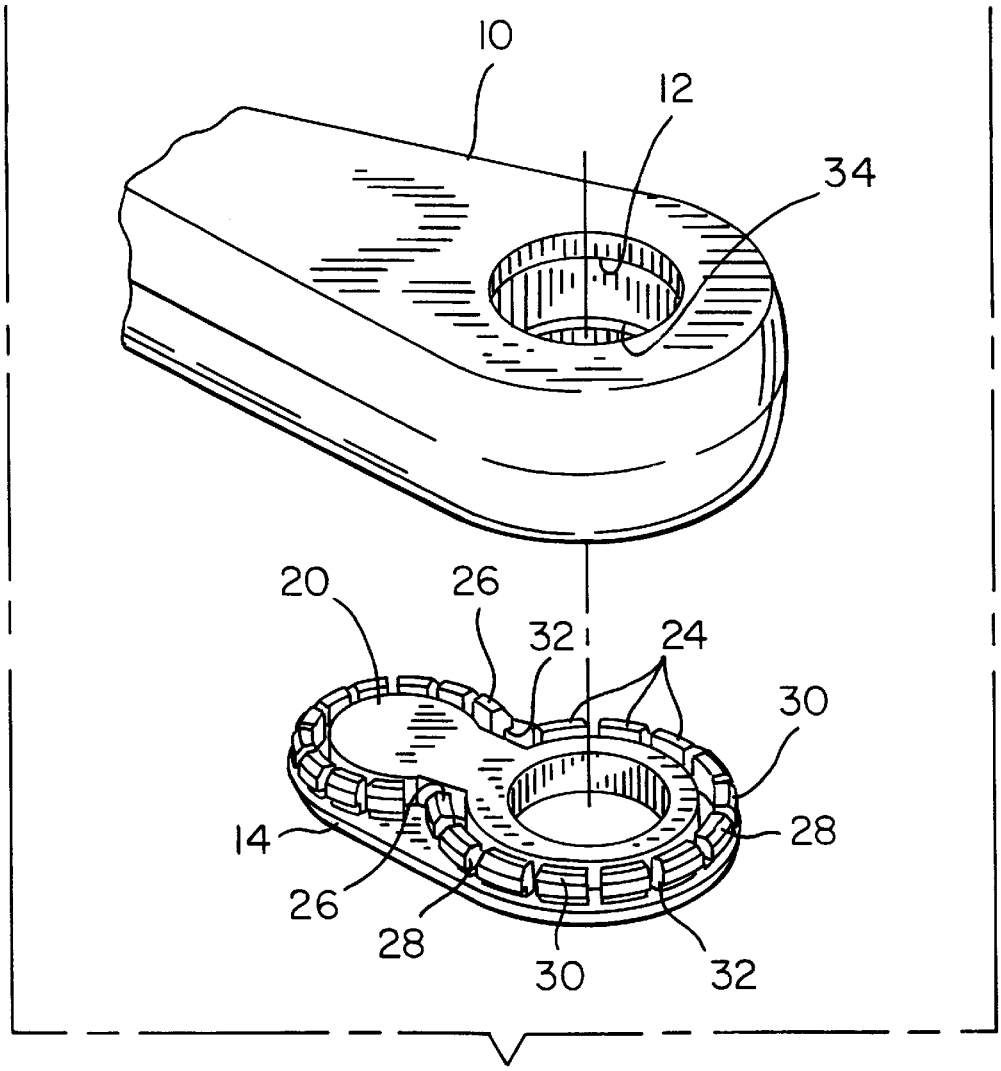
FIG. 6 is a perspective view showing the cover plate of the present invention prior to insertion into the opening in the head of the ratchet wrench, the drive gear not being shown.
Figure 10:
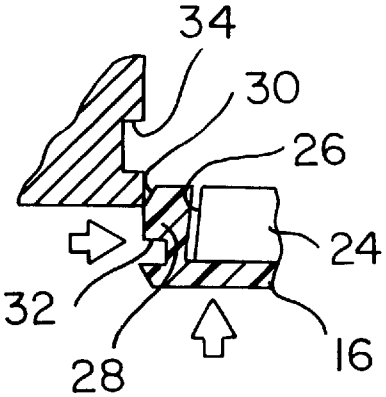
FIG. 10 is an enlarged cross-sectional view showing the cover plate partially inserted into the opening and the segment flexed.
Figure 9:
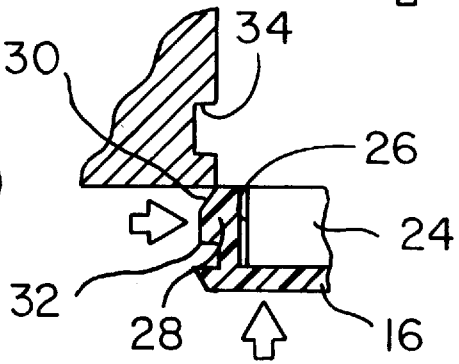
FIG. 9 is an enlarged cross-sectional view showing the chamfered edge of the segment directing the segment into the opening and showing flexing of the segment.
Figure 11:
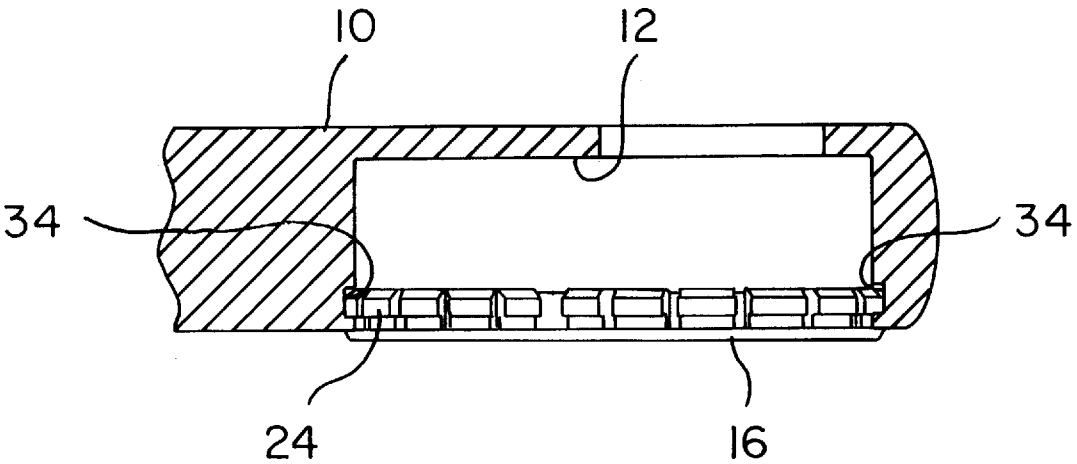
FIG. 11 is a cross-sectional view showing the cover plate of the present invention locked in the channel within the opening in the head of the ratchet wrench.
Figure 12:
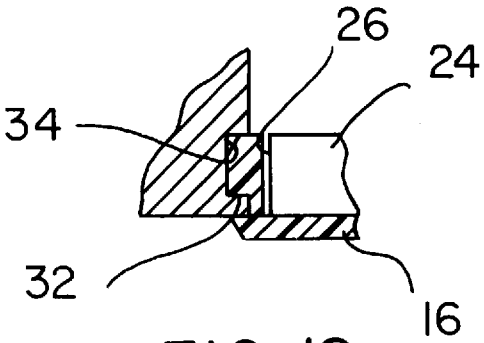
FIG. 12 is an enlarged cross-sectional view showing the step on the segment locked in the channel in the opening.

The opening 12 in the head of the ratchet wrench 10 is covered by placing the cover plate 14 adjacent to the opening 12 with the lower surface 20 of the body 16 directed toward the opening 12 (FIG. 6). The drive tang 36 on the gear drive (not shown) is received in the opening 22 in the cover plate 14. The cover plate 14 is inserted into the opening 12 in the ratchet wrench wherein each protrusion 28 on the end 26 of each segment 24 is engaged by the receiving means 34 in the opening 12 in the head of the ratchet wrench 10. As shown in FIGS. 8–12, the chamfered portion 30 of each protrusion 28 rides over the edge of the opening 12 in the head of the wrench and is directed into the receiving means (i.e., the channel 34 in the head of the ratchet wrench). The chamfered portion 30 assists in directing each segment 24 into the channel 34 and causes each segment 24 to flex inwardly (see arrow) toward the center of the body 16 (FIGS. 9 and 10). A ring 38 is formed around the opening in the cover plate 14 separated from the segments 24 by an annular groove 40. The amount of flexing of the segments 24 is limited by the width of the annular groove 40 such that the respective segments 24 may flex only to the extent that the segment 24 may contact the ring 38 and cannot flex additionally. In this manner, the segments 24 are prevented from being broken or damaged by overflexing. Continued insertion of the cover plate 14 into the opening 12 in the head of the ratchet wrench 10 causes the entire protrusion 28 of each segment 24 to be received within the receiving means 34 (FIG. 11). The step 32 on each protrusion 28 becomes locked in the channel 34 as each segment 24 springs back from the flexed position and the cover plate 14 is locked in the channel 34 (FIG. 12). The cover plate 14 forms a seal between the upper surface 16 of the cover plate 14, which is outside of the opening 12, and the outer surface of the head of the ratchet wrench 10. The upper surface 16 of the body 16 of the cover plate 14 is larger than the opening 12 in the head and the opening is entirely covered when the cover plate 14 is installed. Thus, the infiltration of dirt into the opening is virtually prevented.

It is preferred that the cover plate 14 be formed from corrosion resistant plastic. Thus, the segments 24 may flex and the entire cover plate 14 may be molded from a single unit to reduce costs in fabrication. As previously noted, no auxiliary components (e.g., screws, retaining rings) are required to retain the cover plate 14 to the head of the ratchet wrench. Thus, the number of parts is reduced as well as the labor costs in assembling the ratchet wrench.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A cover plate in combination with a ratchet wrench, the ratchet wrench having a head portion with an opening formed therein, a drive gear and a pawl being disposed in the opening, the cover plate comprising:

a substantially flat body having an upper surface and an opposite lower surface, a plurality of spaced-apart segments formed on the lower surface of the body and extending substantially perpendicularly therefrom, each segment having an end distal from the lower surface, the end of each segment having a respective protrusion formed thereon, receiving means formed within the opening in the head of the ratchet wrench, wherein, when the cover plate is received in the opening in the head of the wrench, the protrusion on the end of each segment engages the receiving means within the opening in the head of the wrench to lock the cover plate in said opening such that a seal is formed between the cover plate and the head of the ratchet wrench and the drive gear and pawl are protected from dirt infiltration.

2. The cover plate of claim 1, wherein the drive gear has a tang formed thereon, the cover plate having an opening therein such that when the cover plate is received in the opening in the head of the ratchet wrench, the tang extends through the opening in the cover plate.

3. The cover plate of claim 1, wherein the cover plate is formed from plastic.

4. The cover plate of claim 1, wherein the cover plate is a single unit.

5. The cover plate of claim 1, wherein each segment is flexible, being deflected as the cover is inserted into the receiving means and retracting into an initial position to lock the cover plate in the receiving means.

6. The cover plate of claim 1, wherein the protrusion on each segment is chamfered outwardly from the end toward the lower surface, wherein, when the cover plate is received in the opening in the head of the ratchet wrench, the chamfered protrusion of each segment is directed into the opening to facilitate engagement between the respective segment and the receiving means.

7. The cover plate of claim 1, further comprising each segment having a step formed on the protrusion oriented toward the lower surface of the cover plate such that when the cover plate is received in the opening in the head of the ratchet wrench, the step on each segment is locked within the receiving means in the opening in the head of the ratchet wrench.

8. The cover plate of claim 1, wherein the receiving means is a channel formed peripherally within the opening in the head of the ratchet wrench and the protrusions on the respective segments are engaged within the channel.

9. The cover plate of claim 1, wherein the plurality of segments are in the form of a figure eight to be received in the head of the wrench.

10. A cover plate in combination with a ratchet wrench, the ratchet wrench having a head portion having an opening formed therein, the opening having a channel formed peripherally therein, the cover plate comprising:

a substantially flat body having an upper surface and an opposite lower surface, a plurality of spaced-apart segments being formed on the lower surface of the body and extending substantially perpendicularly thereto and away from the upper surface, each segment having an end distal from the lower surface, a respective protrusion formed on the end of each segment, each protrusion having a portion chamfered outwardly from the end of the respective segment toward the lower surface, each protrusion having a step formed thereon, the step being oriented toward the lower surface, wherein, when the lower surface of the body of the cover plate is disposed in the opening in the head of the ratchet wrench, the chamfered portion of each segment is directed into the opening, the step on each segment being locked in the channel, wherein a seal is formed between the cover plate and the head of the ratchet wrench and preventing the infiltration of dirt into the opening in the head of the wrench.

11. A method of covering an opening in the head of a ratchet wrench to prevent the infiltration of dirt, comprising the steps of:

providing a cover plate having a substantially flat body having an upper surface and an opposite lower surface, a plurality of spaced-apart segments being formed on the lower surface and extending substantially perpendicularly therefrom, each segment having an end distal from the lower surface, a respective protrusion being formed on the end of each segment, providing a receiving means within the opening in the head of the ratchet wrench, inserting the lower surface into the opening in the head of the ratchet wrench wherein the protrusion on the end of each segment engages the receiving means within the opening in the head of the ratchet wrench to lock the cover plate in said opening, the upper surface of the cover plate being outside of the opening and covering the opening.

12. A ratchet wrench having a head with an upper and a lower surface, an opening being formed between the surfaces, a gear drive with a tang being disposed in the opening in the head, an annular channel being formed within the opening, a cover plate covering the opening on the lower surface of the head, the cover plate comprising:

a single continuous piece having a substantially flat body and an opening therein through which the tang on the gear drive extends, a ring formed about the opening in the body of the cover plate, a plurality of spaced-apart segments formed on the body and extending substantially perpendicular thereto, each segment having a respective protrusion formed on a respective end of each segment distal from the body, an annular groove formed between the ring and the segments, wherein, when the cover plate is received in the opening in the head of the wrench, the protrusion on the end is deflected annularly into the annular groove toward the ring and flexes to engage the annular channel in the opening to lock the cover plate in the opening in the head.

13. The ratchet wrench of claim 12, wherein the plurality of segments are in the form of a figure eight to be received in the opening in the head of the wrench.

14. The cover plate of claim 12, wherein the cover plate is formed from plastic.

15. The cover plate of claim 12, wherein each segment is flexible, being deflected toward the ring as the cover is inserted into the opening in the head of the wrench and retracting into an initial position to lock the cover plate in the annular groove.

16. The cover plate of claim 12, wherein the protrusion on each segment is chamfered outwardly from the end toward the lower surface, wherein, when the cover plate is received in the opening in the head of the ratchet wrench, the chamfered protrusion of each segment is directed into the opening to facilitate engagement between the respective segment and the annular groove.

17. The cover plate of claim 12, further comprising each segment having a step formed on the protrusion oriented toward the lower surface of the cover plate such that when the cover plate is received in the opening in the head of the ratchet wrench, the step on each segment is locked within the annular groove in the opening in the head of the ratchet wrench.

* * * * *